US007703229B2

(12) United States Patent
Parhofer et al.

(10) Patent No.: US 7,703,229 B2
(45) Date of Patent: Apr. 27, 2010

(54) SAFETY DEVICE FOR WEAPONS AND METHOD FOR SECURING WEAPONS PROVIDED WITH A SAFETY DEVICE

(75) Inventors: Stefan Parhofer, Munich (DE); Bernd Dietel, Wiessenstadt (DE); Herbert Meyerle, Maisach (DE)

(73) Assignee: Armatix GmbH, Unterfohring (DE)

( * ) Notice: Subject to any disclaimer, the term of this patent is extended or adjusted under 35 U.S.C. 154(b) by 822 days.

(21) Appl. No.: 10/579,643

(22) PCT Filed: Nov. 21, 2003

(86) PCT No.: PCT/EP03/13100

§ 371 (c)(1),
(2), (4) Date: May 18, 2006

(87) PCT Pub. No.: WO2005/054771

PCT Pub. Date: Jun. 16, 2005

(65) Prior Publication Data

US 2007/0074438 A1 Apr. 5, 2007

(51) Int. Cl.
*F41A 17/00* (2006.01)
*F41A 17/06* (2006.01)
*F41A 17/22* (2006.01)

(52) U.S. Cl. ..... 42/70.01

(58) Field of Classification Search ..... 42/70.01, 42/70.04, 70.05, 70.06, 70.08, 70.11; 89/148, 89/150, 154

See application file for complete search history.

(56) References Cited

U.S. PATENT DOCUMENTS 5,192,818 A 3/1993 Martin ..... 42/70.01
5,448,847 A * 9/1995 Teetzel ..... 42/70.11
5,459,957 A 10/1995 Winer ..... 72/70.11
5,946,840 A * 9/1999 Mickel ..... 42/70.11
6,301,815 B1 10/2001 Sliwa ..... 42/70.01
6,343,140 B1 * 1/2002 Brooks ..... 382/115

(Continued)

FOREIGN PATENT DOCUMENTS

EP 0 912 871 B1 10/2001

(Continued)

OTHER PUBLICATIONS

"International Search Report" for PCT/EP2003/013100.

*Primary Examiner*—Bret Hayes
(74) *Attorney, Agent, or Firm*—Westman, Champlin & Kelly, P.A.

(57) ABSTRACT

Safety device for a hand-held weapon comprising a transponder for authenticating at least one authorized weapon user carrying or wearing the Transponder or for authenticating an allowed area for using the weapon. The transponder is adapted to emit a wireless preferably cryptified authenticating signal. The safety device further comprises a safety component for a grip of the weapon which is adapted to be necessarily activated by a hand of the user when the hand is holding the grip of the weapon and which upon activation emits a wireless request signal. The transponder is adapted to emit the authenticating signal upon receipt of the request signal from the safety component. The safety means receives and processes the authenticating signal from the transponder and permits firing of the weapon by the user upon receipt of an authenticating signal from the transponder authenticating an authorized user.

22 Claims, 2 Drawing Sheets

U.S. PATENT DOCUMENTS

Figure 1:
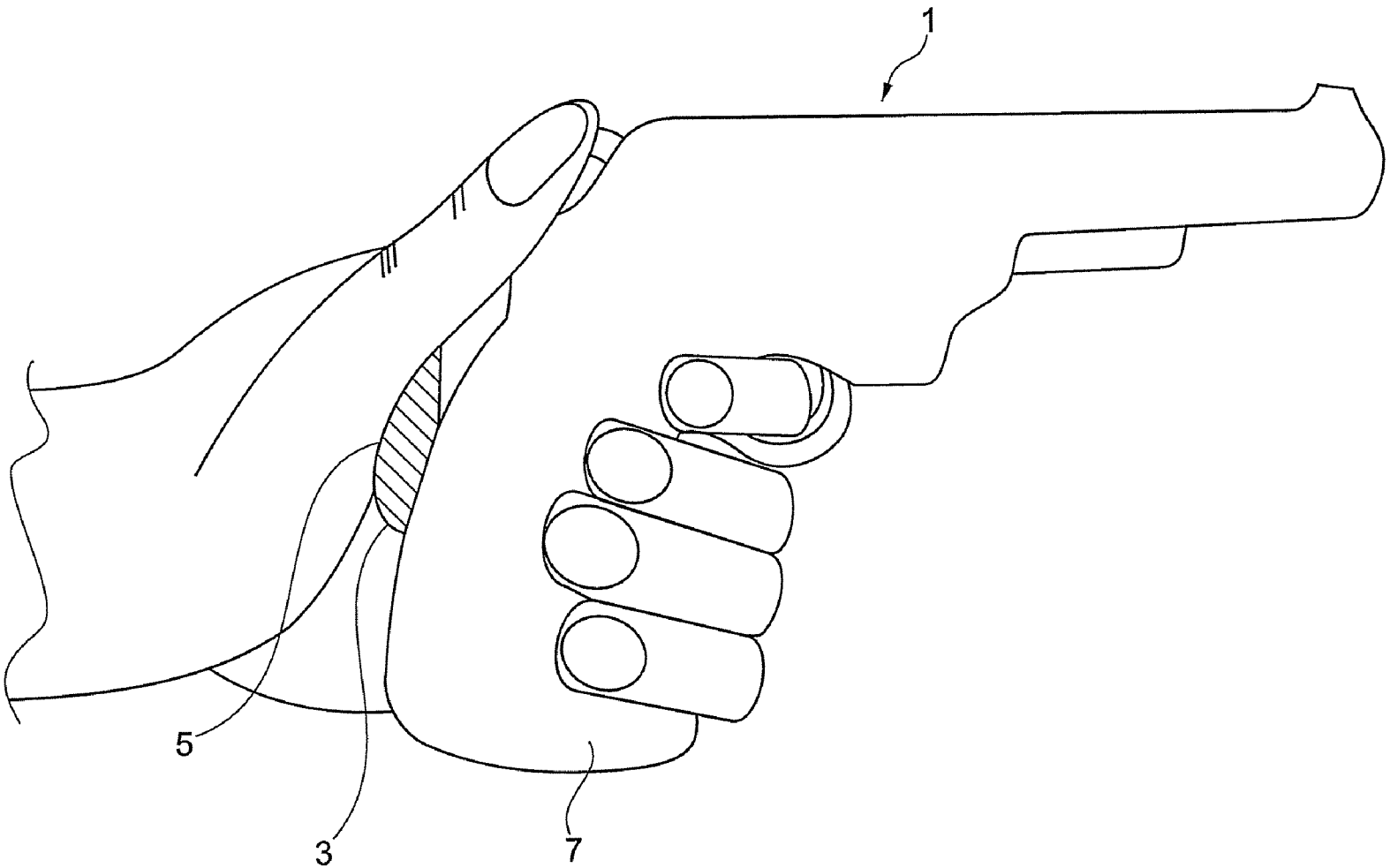

| | | | | |
|---|---|---|---|---|
| 6,412,207 | B1 * | 7/2002 | Crye et al. | 42/70.06 |
| 6,533,149 | B2 * | 3/2003 | Vor Keller et al. | 224/244 |
| 2001/0032405 | A1 | 10/2001 | Kaminski | 42/70.05 |
| 2001/0042332 | A1 | 11/2001 | Gering et al. | 42/70.08 |
| 2003/0070343 | A1 * | 4/2003 | Glock | 42/70.11 |
| 2004/0244253 | A1 * | 12/2004 | Glock | 42/70.11 |
| 2006/0117632 | A1 * | 6/2006 | Meyerle | 42/70.01 |
| 2006/0208857 | A1 * | 9/2006 | Wong | 340/5.82 |

FOREIGN PATENT DOCUMENTS

| | | |
|---|---|---|
| WO | WO 00/65291 | 11/2000 |

* cited by examiner

SAFETY DEVICE FOR WEAPONS AND METHOD FOR SECURING WEAPONS PROVIDED WITH A SAFETY DEVICE

CROSS-REFERENCE TO RELATED APPLICATION

The present application is a 371 of and claims priority of International patent application Serial No. PCT/EP2003/013100, filed Nov. 21, 2003, and published in English the content of which is hereby incorporated by reference in its entirety.

The present invention relates generally to weapons including a safety device for preventing firing of the weapon by an unauthorized user.

First of all weapons are used in various fields, e.g., in the police service, the security service, the military service, in riflemen's associations, hunters associations and in the private field.

In commonly known weapons usually each person can fire a weapon by simply releasing the safety of the weapon. Thus it is not possible to prevent firing of the weapon by persons which are not allowed thereto.

However, several attempts have been made in the prior art to prevent that a weapon can be fired by an unauthorized user.

In U.S. Pat. No. 5,459,957 a security and safety mechanism is disclosed for a firearm including a disabling unit that interacts with a firearm grip safety in order to enable/disable the firearm. The firearm will remain in a disabled state unless verification means determines that a firearm user is an authorized firearm user. The security and safety mechanism utilizes voice recognition technology wherein a user utters a PIN Code into a microphone of the weapon creating a signal which is processed by a CPU and compared to a previously stored signal in a system memory of the weapon. If the signal is verified as the correct PIN and the correct voice a solenoid is activated to rotate a blocking lever out of the path of a grip safety thereby rendering the weapon ready to fire.

This system has the disadvantage that the voice recognition cannot reliably recognize the voice of an authorised user e.g. when the user is ill (for example has a cold) or is in a hectic or nervous mental condition or due to loud background noise. All those circumstances can have a very negative influence on the voice pattern of a user. Furthermore, the microphone can be easily damaged or get dirty so that the recording of the voice can be irritated and thus the weapon does not permit firing although the user is authorized.

In EP 0 912 871 B1 a device for securing a firearm is disclosed which comprises a locking mechanism and an identification system for wirelessly exchanging a non-changeable identification code. A transmitter and/or receiver unit is assigned to an authorized user and another is assigned to the identification system. The locking mechanism can be de-activated by the identification system at a distance or in a distance range of 0 to 1000 mm between the transmitter and/or receiver units of the authorized user and the identification system when their identification codes match.

The device has the disadvantage that the transmitter and/or receiver units are in a kind of stand by position wherein a signal is transmitted and can be received and further processed as soon as the transmitter and/or receiver units of the authorized user and the identification system have reached a certain distance between each other. Thus the device has a significant high energy consumption.

In WO 00/65291 a fire weapon control system is disclosed including safety means for preventing firing of the weapon by an unauthorized user. The system comprises a weapon having a weapon control means including a reader which is lodged in a hollow part of the weapon handle. Said reader comprises a transceiver composed of a signal transmitter means and signal receiver means. The output of the receiver means is used to control the position of the safety means. The system further comprises a user identification element such as a ring or bracelet which is worn by a user of the weapon. Said element has a transponder which is adapted to receive a signal from the transmitter means and to generate a transponder signal back to the weapon. The receiver means in the weapon have recognition means responsive to at least one coded identification carried by the transponder signal and means for generating an output signal to operate the safety means for release of the safety means to the armed position. Furthermore, the handgun control system comprises a switch for connecting a power supply to electric circuits of said control means when the user holds the handle of the handgun or when the pressure is applied to the trigger.

The object of the present invention is therefore to provide an improved safety device for weapons.

This object is achieved by the features of the independent claims.

The invention has the advantage that the safety means is necessarily activated by a hand of the user when the hand is holding the grip of the weapon. When activated, the safety means emits a wireless request signal. Since the safety means emits said request signal only when being activated the energy consumption can be reduced since it is not necessary that the safety means is held in a stand by position. Furthermore, the safety of the weapon cannot be released before the safety means are activated by a hand of the user when the hand is holding the grip of the weapon.

In a preferred embodiment of the invention a transponder comprises a further switch for activating the transponder for a given period of time for emitting the authenticating signal. This has the advantage that the transponder can also be activated by a user and is only then, within a given period of time, able to send the authenticating signal. In the preferred embodiment the transponder further comprises a biometric sensor, preferably a fingerprint sensor, for identifying an authorized user before activating the transponder for a given period of time for emitting the authenticating signal. This prevents a miss-use of a weapon and the respective safety device in case a non-authorized user is in the possession of the weapon with the safety device and the respective transponder.

More preferably a safety disconnector is provided, preferably at the transponder, which is adapted to de-activate the transponder and/or the safety means in situations in which a non-authorised user wants to use the transponder or the weapon. This is particularly useful in case the weapon is in the hand of a non-authorised user but within the range of activity of the transponder. In this case the safety disconnector e.g. at the transponder can be used to de-activate the safety means of the weapon so that the non-authorised user cannot fire the weapon.

The invention will now be described with reference to the figures in which

Figure 2:
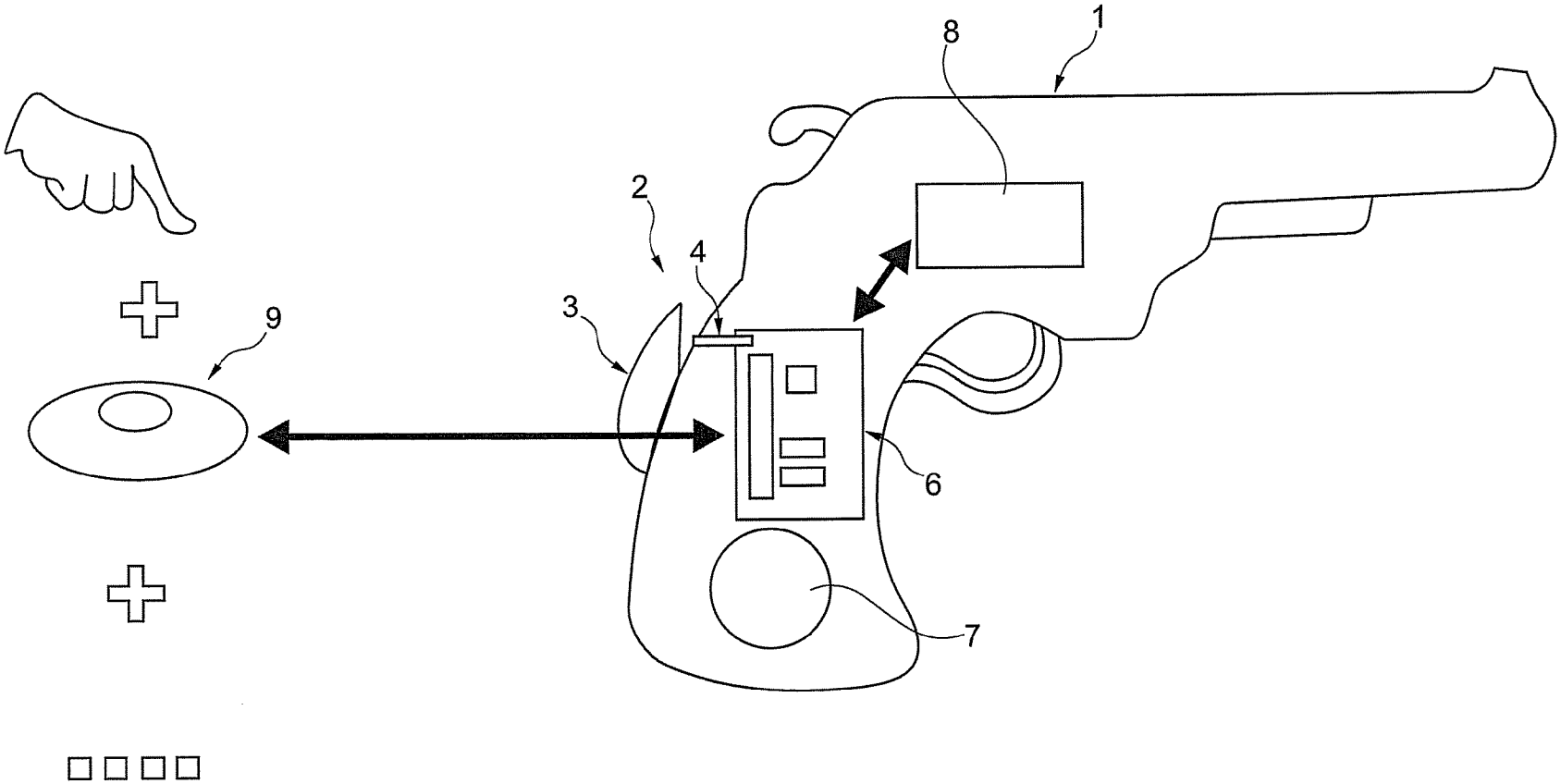

FIG. 1 shows one embodiment of the invention wherein the safety means is activated by a hand of the user when the user is holding the grip of the weapon, and FIG. 2 shows a weapon and a transponder according to the safety device of the invention.

In an embodiment of the weapon 1 according to the invention, as shown in FIG. 1, a safety means is disclosed which comprises a switch 3 which is situated to be essentially activated by the users eminences of hand close to the thumb (Musculus abductor pollicis brevis). In other words, when the user takes the grip of the weapon in his hand he actuates the switch automatically with his eminences of hand without the necessity to additionally encompass with his hand. The switch corresponds with the symmetry of the hand.

In some weapons of the state of the art said switch has the function to prevent an unintentional release of the protection of the weapon, since said switch has to be actuated before the weapon can be fired. In other words, the switch releases the protection of the weapon when actuated. Thus the weapon cannot fire unintentionally e.g. when being dropped.

According to the present invention said switch 3 is preferably integrated into the safety means 2. This has the advantage that no complicated and costly changes in the construction of the weapon 1 have to be made. Furthermore, since said switch 3 can be integrated into the safety means 2 user of weapons do not have to change their habits, that means a "Handsfree Operation" is possible. Furthermore, the safety means 2 can be actuated as long as the switch 3 is actuated.

In alternative embodiments of the invention instead of the switch 3 any other device can be provided which is suitable to be actuated by a hand of the user when the user is holding the grip of the weapon. For example a sensor can be provided which is "actuated" when it determines that a user takes the grip of the weapon in his hand. The sensor is preferably an optical sensor and/or a pressure sensitive sensor and/or a capacitive sensor and/or a resistance sensor.

In the following, the present invention will be described exemplary based on the switch 3 as one possibility among other possibilities to actuate the safety means 2.

With reference to FIG. 2 the present invention will be explained in more detail.

First of all, the weapon 1 disclosed in FIGS. 1 and 2 is a hand gun. However, within the scope of the invention the weapon can be also any similar firearm such as a rifle or a rapid firing assault weapon etc.

As disclosed in FIGS. 1 and 2 the weapon 1 comprises a switch 3 which is located at the grip 7 of the weapon. The switch 3 can be preferably actuated by the users eminences of hand 5 as disclosed in FIG. 1. As pointed out before any other device can be provided instead of the switch 3 which is suitable to be actuated by a hand of the user when the user is holding the grip of the weapon to actuate the safety means 2.

The switch 3 which is actuated by the users eminences of hand 5 as disclosed in FIG. 1 has the function in weapons known in the art to release the protection of the weapon when actuated. This prevents an unintentional firing of the weapon.

In the present invention the switch 3 is part of the safety means 2. Said safety means 2 emits a wireless request signal when being activated by a hand of the user when the hand is holding the grip 7 of the weapon 1. In the present case the safety means 2 is actuated by actuating the switch 3. Preferably the safety means 2 comprises a sensor 4 to sense when the switch 3 is actuated. It is clear to a person skilled in the art that the switch can be located at any position on the weapon which is suitable so that the switch can be actuated by a hand of the user when the user is holding the grip of the weapon.

The request signal of the safety means 2 is received by a transponder 9.

Depending on the field in which the transponder 9 is used the transponder can be adapted to be carried by an authorized user of the weapon as shown in FIG. 2 or as an alternative the transponder 9 can be installed in an area where one or more users of a weapon is allowed to use the weapon, e.g. in a shooting stand. This has the advantage that a localization can be achieved by an installation of one or more transponder stations at fixed positions e.g. in a riflemen's club-house.

In case the transponder 9 receives the request signal from the safety means 2 the transponder 9 emits an authenticating signal to the safety means 2 in case the user is authorized to use said weapon 1. The safety means 2 receives and further processes the authenticating signal from the transponder 9 to permit firing of the weapon 1 by the user in case the authenticating signal from the transponder 9 authenticates an authorized user.

In an embodiment of the invention, the safety means 2 comprises an electronic control unit 6 to control a blocking mechanism or a blocking unit 8 of the weapon. When the safety means 2 receives the authenticating signal from the transponder 9 said signal is processed in said electronic control unit 6 which actuates the blocking unit 8 to release the protection of the weapon in case a user is identified as authorized thereto.

In case the user of the weapon 1 is not authorized, the transponder 9 emits no signal or a signal which does not authenticate the user as authorized. In the latter case the safety means 2 which has received the signal from the transponder 9 recognizes that the signal is not an authenticating signal and therefore does not communicate to the blocking unit 8 of the weapon to release protection of the weapon or does even block the safety means in the weapon e.g. for a given period of time.

In an alternative embodiment the transponder 9 does not send a signal in case a user is not authorized. Thus the weapon 1 remains blocked since the safety means 2 do not receive an authenticating signal from the transponder 9.

In a preferred embodiment of the invention the safety means and the transponder 9 communicates with each other by a bidirectional wireless signal transmission which is more preferably based on a challenge response algorithm. This has the advantage that the reliability of the identification can be further improved.

Furthermore, by including the switch 3 which is actuated by the eminences of hand to release the protection of the weapon in the safety means 2 no complicated construction is necessary to actuate the safety means 2 to emit a wireless request signal. In particular, the interface between the weapon 1 and the transponder 9 can be provided within a wide range, since the construction of the weapon 1 does not have to be changed essentially. Thus production costs and development costs can be reduced significantly.

In a further embodiment the safety means 2 is actuated as long as the switch 3 is actuated. That means in other words that the switch 3 is always actuated during the period of time the weapon 1 is used for firing. In case the switch 3 is released the weapon 1 is preferably blocked. To use the weapon again for firing the switch 3 has to be actuated so that the safety means 2 emits a new wireless request signal to the transponder 9. As described above, upon receipt of an authenticating signal from the transponder 9 the safety means 2 permits firing of the weapon by the user by operating the blocking unit 8.

In an embodiment of the invention the transponder 9 comprises a biometric sensor for example a fingerprint sensor to identify an authorized user before the transponder 9 is activated for a given period of time to emit an authenticating signal. This has the advantage that the security can be further improved since an unauthorized user cannot activate the transponder 9 to emit an authenticating signal. Furthermore, additional security features can be integrated in the transponder 9 such as e.g. the biometric sensor described above to verify if a user of the transponder 9 is authorized thereto etc. without the necessity of changing the construction of the weapon. Some other additional security features will be described in the following.

As an alternative to the biometric sensor or in addition thereto, the transponder 9 can be provided with a key (keys) to enter a personal code(s) (e.g. a PIN-code) for identifying an authorized user before the transponder 9 is activated to emit an authentication signal. It is clear that the invention is not limited to the biometric sensor and the keys for entering a code(s) to identify an authorized user(s) of the transponder. Any other sensors or devices suitable to identify an authorized user are within the scope of the invention.

The transponder 9 can be further configured to provide an authenticating signal within a certain range of e.g. approximately 20 cm to 1.5 m and preferably approximately 80 cm. This is advantageous for example when the transponder 9 has a fixed position e.g. in a shooting stand in which the transponder 9 is used to activate a weapon (weapons) therein. This allows e.g. that a transponder 9 can be located or worn in a protected area in which the transponder 9 is protected e.g. from being damaged or from attempts of manipulation etc. so that the transponder 9 can be activated and emit an authenticating signal to the safety means 2 of the weapon 1 e.g. outside said protected area. It is clear that the range in which the transponder 9 is configured to provide an authenticating signal can be varied depending on the field for which the transponder is used. That means that the invention is not limited to the range as mentioned above but can also provide a range considerably larger or smaller.

As mentioned before the transponder 9 can be adapted to be carried or worn by a user e.g. on the body, in a pocket or as a ring or a bracelet etc. As an alternative the transponder 9 can be also adapted to be mounted e.g. in an area for using weapons such as e.g. a shooting stand or in a private area or in a particular protected area. Preferably the weapon 1 can be fired as long as the switch 3 is actuated by the eminences of the hand of the user.

In an embodiment of the invention the transponder 9 can be configured to be used for different users of the weapon of the safety device. This has the advantage that one transponder 9 can be used for different users of a weapon 1.

The transponder 9 and/or the safety means 2 correspond with each other and/or are programmable in order to authorize a user or a group of users. The transponder 9 and/or the safety means 2 communicate with each other and/or are programmable on a wireless basis, based on a bidirectional wireless signal transmission. The signal transmission is based on a Challenge response algorithm, with a magnetic frequency of approximately 2.5 kHz or by Bluetooth® wireless communication technology for exchanging data over short distances interfaces.

In a further embodiment of the invention different transponders 9 can be used for different users of the weapon of the safety device. This has the advantage that the weapon 1 can be actuated by different users having their own transponder 9.

In a further embodiment of the invention, the request signal and/or the authenticating signal can be communicated by a magnetic frequency of approximately 25 kHz.

Furthermore, the safety means 2 of the invention can be adapted to permit firing of the weapon 1 under certain conditions once the safety means 2 has received an authenticating signal from an authorized user. The safety means 2 can permit firing of the weapon 1 as mentioned above during the period of time the switch 3 is actuated.

As an alternative or in addition the safety device can permit firing of the weapon 1, e.g. for a given number of shoots and/or for a given period of time and/or in a certain transmitting range which must not be left by the user (e.g. a range of preferably approximately 80 cm when the transponder is not installed at a fixed position and a range up to 1.5 m in case the transponder is located at a fixed position). Preferably the given period of time and/or number of shots can be varied for different transponders 9 of different users of the weapon.

More preferably, the past activity of the weapon 1 can be documented. In this case, the safety means 2 can be regularly interrogated or inquired in case e.g. the switch 3 is actuated.

Further, the activities of the transponder 9 and/or the safety means 2 are preferably lodged and readable by a computer. This has the advantage that the activities of the weapon can be reconstructed and e.g. directly stored in the computer similar to a black box in airplanes.

Moreover, the transponder 9 can be adapted to also communicate with a compartment for weapons, such as a locker, in order to give an authorized person access to the compartment. This has the advantage, that the transponder 9 can be also used to prevent that an unauthorized user can open the compartment for weapons.

In an embodiment of the invention the safety device comprises a safety disconnector. Said safety disconnector is adapted to deactivate the transponder 9 and/or the safety means 2 in case of an emergency so that a user cannot fire the weapon 1.

According to the invention the safety disconnector is preferably provided at the transponder. This has the advantage, that in case the weapon 1 has been stolen the authorized user can prevent that another person can assault him with his own weapon by actuating the safety disconnector of the transponder to deactivate the safety means 2 of the weapon, so that no firing of the weapon is permitted. Further the transponder can be also deactivated by the safety disconnector, so that an unauthorized user cannot make use of the transponder.

It is obvious for the person skilled in the art that the present invention is not limited by what has been particularly shown and described hereinabove. Rather the scope of the present invention includes both combinations and sub-combinations of the features described hereinabove as well as modifications and variations thereof which would occur to a person skilled in the art upon reading the foregoing description and which are not in the prior art.

The invention claimed is:

1. Safety device for a hand-held weapon comprising:

(a) a transponder for authenticating at least one authorized weapon user carrying or wearing the transponder or for authenticating an allowed area for using the weapon, (b) wherein the transponder is formed as a relatively small device to be constantly carried or worn by the user and is configured to emit a wirelessly cryptified authenticating signal;

(c) wherein the transponder further comprises a switch for activating the transponder for a given period of time for emitting the authenticating signal and comprises a biometric sensor, for identifying an authorized user before activating the transponder, (d) a safety means for a grip of the weapon which is configured to be necessarily activated by a hand of the user when the hand is holding the grip of the weapon and which upon activation emits a wireless request signal, (e) wherein the transponder is configured to emit the authenticating signal upon receipt of the request signal from the safety means, (f) wherein the safety means is further configured to receive and process the authenticating signal from the transponder; and (g) wherein the safety means is configured to only permit firing of the weapon by the user upon receipt of an authenticating signal from the transponder authenticating an authorized user, wherein the safety device is configured to permit firing of the weapon for a given number of shots or for a given period of time once the safety means has received an authenticating signal from an authorized user.

2. Safety device according to claim 1, wherein the safety means and the transponder communicate with each other wirelessly, by a bidirectional wireless signal transmission.

3. Safety device according to claim 2, wherein the signal transmission is based on a Challenge response algorithm, with a magnetic frequency of approximately 25 kHz or via Bluetooth® wireless communication technology interfaces.

4. Safety device according to claim 1, wherein the safety means comprises a switch which is located on the weapon so that the safety means can be actuated by a hand of the user when the hand is holding the grip of the weapon.

5. Safety device according to claim 4, wherein the switch is situated to be essentially actuated by the wearer's eminences of hand.

6. Safety device according to claim 4, wherein the safety means is actuated when the switch is actuated and deactivated when the switch is deactivated.

7. Safety device according to claim 4, wherein the device is regularly interrogated or inquired in case the switch is actuated.

8. Safety device according to claim 1, wherein the safety means comprises at least one sensor, of the group consisting of an optical sensor, a pressure sensitive sensor, a capacitive sensor and a resistance sensor, which is located on the weapon so that the sensor can be actuated by a hand of the user when the hand is holding the grip of the weapon.

9. Safety device according to claim 8, wherein the safety means is actuated when the sensor is actuated and deactivated when the sensor is deactivated.

10. Safety device according to claim 8, wherein the device is regularly interrogated or inquired in case the sensor is actuated by a hand of the user when the hand of the user is holding the grip of the weapon.

11. Safety device according to claim 1, wherein the transponder comprises keys for entering a personal code for identifying an authorized user before activating the transponder a given period of time for emitting the authentication signal.

12. Safety device according to claim 1, wherein the transponder can be configured to provide an authenticating signal within a range of approximately 20 cm to 1.5 m.

13. Safety device according to claim 1, wherein a different transponder can be used for a different user of the safety device.

14. Safety device according to claim 1, wherein the period of time can be varied for a different transponder of different a user of the safety device.

15. Safety device according to claim 1, wherein the transponder is configured to also communicate with a compartment for weapons, in order to give an authorized person access to the compartment.

16. Safety device according to claim 1, wherein the transponder and/or the safety means is programmable in order to authorize a user or a group of users.

17. Safety device according to claim 16, wherein the safety means is programmable wirelessly.

18. Safety device according to claim 1, wherein the request signal and/or the authenticating signal are communicated wirelessly.

19. Safety device according to claim 1, comprising a safety disconnector which is configured to deactivate the transponder and/or the safety means in case of an emergency, so that a user cannot fire the weapon.

20. Safety device according to claim 1, wherein activities of the transponder and/or the safety means is logged and readable by a computer.

21. Method for securing a hand-held weapon, particularly for operating a safety device according to claim 1 comprising:

(a) providing a transponder which is configured to be constantly carried or worn by a user and which is a configured to emit a wirelessly cryptified authenticating signal which authenticates at least one authorized weapon user or authenticates an allowed area for using the weapon, wherein the transponder is further configured to be activated for a given period of time for emitting the authenticating signal and wherein the transponder is configured to identify an authorized user before being activated, (b) activating a safety means for a grip of the weapon by a hand of the user when the hand is holding the grip of the weapon and emitting upon activation a wireless request signal by the safety means, (c) emitting the authenticating signal by the transponder upon receipt of the request signal from the safety means, (d) wherein the safety means is further configured to receive and process the authenticating signal from the transponder; and (e) wherein the safety means is configured to only permit firing of the weapon by the user upon receipt of an authenticating signal from the transponder authenticating an authorized user, wherein the safety device is configured to permit firing of the weapon for a given number of shots or for a given period of time once the safety means has received the authenticating signal from the authorized user.

22. Safety device according to claim 1, wherein the biometric sensor is a fingerprint sensor.

* * * * *